US005634602A

United States Patent [19]

Göbbels et al.

[11] Patent Number: 5,634,602

[45] Date of Patent: Jun. 3, 1997

[54] OPEN END SPINNING MACHINE WITH ASSOCIATED SERVICE DEVICE

[75] Inventors: Heinz-Dieter Göbbels, Mönchengladbach; Stephan Kaspers, Viersen; Hans-Willi Esser; Volker Reichardt, both of Mönchengladbach, all of Germany

[73] Assignee: W. Schlafhorst AG & Co., Moenchengladbach, Germany

[21] Appl. No.: 560,194

[22] Filed: Nov. 21, 1995

[30] Foreign Application Priority Data

Dec. 9, 1994 [DE] Germany ..... 44 43 818.4

[51] Int. Cl.[6] ..... B65H 54/00; B65H 75/28; D01H 13/26

[52] U.S. Cl. ..... 242/18 PW; 57/263; 242/125.1

[58] Field of Search ..... 242/18 PW, 35.5 A, 242/125.1; 57/263, 261, 278, 269

[56] References Cited

U.S. PATENT DOCUMENTS

| | | | |
|---|---|---|---|
| 3,955,768 | 5/1976 | Fluck et al. | 242/18 PW |
| 4,093,135 | 6/1978 | Hermanns | 242/18 PW |
| 4,164,330 | 8/1979 | Maassen et al. | 242/18 PW |
| 4,195,788 | 4/1980 | Miyazaki et al. | 242/18 PW |
| 4,634,064 | 1/1987 | Burkhard et al. | 242/18 PW |
| 4,662,574 | 5/1987 | Slavik et al. | 242/18 PW |
| 5,083,420 | 1/1992 | Rupert et al. | 57/263 |
| 5,246,178 | 9/1993 | Badiali et al. | 242/35.5 A X |
| 5,473,879 | 12/1995 | Gobbels et al. | 57/263 |
| 5,511,734 | 4/1996 | Enger et al. | 242/18 PW |

FOREIGN PATENT DOCUMENTS

| | | |
|---|---|---|
| 2501338B2 | 3/1977 | Germany . |
| 0106809A1 | 4/1984 | Germany . |
| 0203508B1 | 12/1986 | Germany . |
| 3801964A1 | 7/1989 | Germany . |
| 0311987B1 | 11/1991 | Germany . |
| 4231730A1 | 4/1993 | Germany . |
| 4313523A1 | 10/1994 | Germany . |

*Primary Examiner*—Michael Mansen
*Attorney, Agent, or Firm*—Shefte, Pinckney & Sawyer

[57] ABSTRACT

An open end spinning machine with an associated service device having a supplementary yarn conveying device utilizing a delivery tube disposed on a delivery tube holder which can be pivoted into various work positions. A yarn guide plate is movably seated in the area of the delivery tube holder and has a yarn guide notch as well as a yarn placement slit and can be selectively controlled by means of a thrust cylinder. By pivoting the yarn guide plate, the yarn extending through the yarn guide notch is transferred to specially designed yarn catch devices of a tube supporting disk seated in a creel of a work station of the spinning machine. Subsequently, the grasped yarn slides automatically into the yarn placement slit which is disposed below the notch and, while being securely guided in the yarn placement slit, is wound as a reserve winding on the empty tube rotating in the creel.

14 Claims, 6 Drawing Sheets

OPEN END SPINNING MACHINE WITH ASSOCIATED SERVICE DEVICE

FIELD OF THE INVENTION

The present invention relates to a cheese-producing textile machine having multiple work stations, such as an open end spinning machine, and relates more particularly to such a machine having a service device moveable along and selectively positionable at the work stations and equipped with a supplementary yarn conveying device for supplying and positioning of a supplementary yarn to be used for a yarn joining process, wherein the supplementary yarn can be placed on an empty tube held in a spinning frame by means of a pneumatically operated supply tube disposed in a supply tube holder.

BACKGROUND OF THE INVENTION

Service devices are disclosed in the prior art which operate, after a yarn breakage has occurred, to first clean the spinning element and then perform a yarn joining process by means of a yarn end which is aspirated from a cheese maintained in the spinning frame of the spinning station. These known service devices cooperate with special cheese changing carriers which exchange starter tubes for finished cheeses. The starter tubes, which are transferred from the changing carrier to the spinning frame of the spinning station, already contain a defined amount of yarn which the service device requires for joining the yarn being spun to the new starter tube.

Also known are service devices which repair "normal" yarn breaks and are also able to perform cheese changes and in addition immediately dispose of a supplementary yarn used in yarn joining. The service device known from European Patent Publication EP 0 106 809 A1, for example, has a supplementary yarn conveying device with a plurality of sequentially triggered supplementary yarn transfer elements. The supplementary yarn, which is stored on a supply bobbin, is first grasped by a yarn clamp disposed on the end of a pivot lever, and is conveyed from there into the area of a suction nozzle. For joining the yarn, the suction nozzle brings the supplementary yarn to the spinning box. In the course of transferring the supplementary yarn by means of the pivot lever, the yarn end is passed along another suction nozzle which in the process aspirates a yarn loop. After the new yarn has been joined up, this second suction nozzle, which can be pivoted into the area of the spooling device, places the new yarn on an empty tube held in the creel of the spinning station.

The yarn joining unit in accordance with European Patent Publication EP 0 203 508 B is equipped with a supplementary yarn conveying device having two separate suction nozzles as well as two individually triggerable yarn clamps. With this device, the supplementary yarn is pulled off a supply bobbin by a yarn supply installation, is grasped at the supply installation outlet by a suction nozzle and is transferred in the area of a spooling device while forming a strand of yarn. The supplementary yarn is subsequently positioned by a centering means and, in the process, is aspirated by the yarn locating nozzle of a yarn joining unit. Since the first suction nozzle continuously aspirates, it is necessary to secure the supplementary yarn end, which is brought by a first yarn clamping device into the area of the spinning box, by means of a second yarn clamp during the return of the supplemental yarn into the spinning rotor, because otherwise the yarn end would be aspirated into the first suction nozzle.

European Patent Publication EP 0 311 987 B describes a service device with a pneumatic-mechanical supplementary yarn conveying device. A supplementary yarn pulled off a supply bobbin is first placed into a mechanical feed device by a pneumatic yarn conveying device, which brings the yarn end in the area of the spooling station and transfers it to a particular suction nozzle of a yarn joining carrier. Subsequently the yarn is pulled off after rejoining by means of the mechanical yarn feed device.

The above-described service devices are relatively complicated in their design. In addition, them is the danger that the yarn becomes lost in the course of the repeated transfers.

German Patent Publication DE 43 13 523 A1 describes a further development in service devices of the above-described types. This known yarn joining unit has a supplementary yarn conveying device with a supply tube which can be pivoted into different work positions. The service device has the advantage of simple construction. Furthermore, the supplementary yarn is continuously guided in a handling device during the entire cheese change/yarn joining cycle, wherein the supply as well as the disposal of the supplementary yarn takes place by means of the supplementary yarn conveying device, which is embodied with a pivotable supply tube at the end. For this purpose, it is possible to switch the device either to a compressed air connector or a suction air connector in a defined manner. A yarn guide element with a pivotable yarn guide creel is disposed in the area of the supply tube which is intended to insure that the yarn is clamped on the empty tube or the tube disk.

SUMMARY OF THE INVENTION

It is accordingly an object of the present invention to provide an improved yarn joining unit for traveling service devices of the above-described type.

Briefly summarized, this objective is achieved in a service device for use with open end spinning machines and like textile machines for winding yarn into cheese-type yarn packages, wherein the service device is adapted to be transportable along the associated textile machine for selective positioning at a work station requiring the yarn being wound into a cheese to be attached to a winding tube. Basically, the service device has a supplementary yarn conveying device for supplying and positioning of a supplementary yarn to be joined with the yarn being wound for use in placing the yarn being wound onto the winding tube, the supplementary yarn conveying device including a pneumatically operated delivery tube for supplying the supplementary yarn and a holder having the pneumatically operated delivery tube attached thereto for movement thereof to and from the yarn winding tube. According to the present invention, a yarn placement device is attached to the delivery tube holder for manipulating the supplementary yarn to place it onto the winding tube, the yarn placement device having a pivotable yarn guide plate and a yarn retainer element, and the yarn guide plate having a yarn guide contour in which is formed a yarn guide notch and a yarn placement slit.

In the preferred embodiment, a stop is disposed on the yarn guide plate for engagement against a positioning surface of the work station to align the yarn guide plate axially in respect to the yarn winding tube. Also, a positioning aid is disposed on the delivery tube holder and corresponds with a stop on the work station.

The yarn retainer element is disposed in advance of the yarn guide plate in the yarn traveling direction and is laterally offset in respect to the yarn guide plate for initial positioning of the yarn guide plate with its yarn placement slit adjacent the yarn retainer element.

Preferably, the yarn guide plate is seated rotatably on a horizontal pivot shaft and is biased by a spring-loaded biasing device disposed in the area of the pivot shaft, and a pneumatic thrust cylinder is provided for actuating pivoting movement of the yarn guide plate. A force-limiting element is disposed between the thrust cylinder and the yarn guide plate, preferably comprising a helical spring.

It is further preferred that the delivery tube of the supplementary yarn conveying device has a compressed air connector with an injector device and a yarn cutting device in the area of the delivery tube holder. Additionally, the delivery tube has a bifurcated outlet defining spaced-apart outlet sections and a yarn cutting device having a cutting and closure slider displaceable across the outlet sections. The cutting and closure slider has a forward-facing cutting edge and a rearward perforated screen spaced from the cutting edge.

On the one hand, the design of the delivery tube holder in the present invention to have a supply tube, a pivotable yarn guide plate with a yarn guide notch, a yarn placement slit and a yarn retainer element arranged at an offset with respect to the yarn guide plate, assures in a simple manner that the yarn initially guided in the top yarn guide notch at the start of the yarn transfer is displaced sufficiently by outward pivoting of the yarn guide plate into the area of the catch notches disposed on the yarn tube supporting disk to be caught by the catch notches. On the other hand, the yarn caught in the catch notches is subsequently pulled automatically into the yarn placement slit, whereby the position of the reserve winding which is to be wound at the start of winding a new yarn tube is exactly defined. In the course of the yarn guide plate pivoting back, the yarn coming from the spinning box or other yarn spinning member is pushed out of the yarn placement slit by the yarn retainer element and can be taken over by the yarn changing device of the spooling station when it slides away downwardly along the yarn retainer element.

In a preferred embodiment, the stop disposed on the yarn guide plate comes to rest against the creel during the inward pivoting of the yarn guide plate. In this way, an exact lateral positioning of the yarn guide plate and thus its yarn guide and yarn placement means is assured.

In accordance with a further embodiment of the invention, the height adjustment of the supply tube holder in respect to the creel is provided by means of a positioning aid disposed on the supply tube holder, which engages a fork-shaped stop at the creel during the inward pivoting of the supply tube holder into the yarn transfer position, and in the process aligns the creel in respect to the height.

In an advantageous embodiment of the invention, the yarn guide plate is pivotably seated on a horizontal pivot axis and is maintained in its initial position by a spring-loaded restoring device disposed in the area of the pivot axis. The pivoting of the yarn guide plate into the yarn transfer or the yarn changing position preferably takes place by means of a pneumatic thrust cylinder, with a force-limiting element, for example a helical spring, inserted between the thrust cylinder and the yarn guide plate. Damage to the yarn guide plate because of the effects of uncontrolled forces from the thrust cylinder are prevented in this manner.

In a further embodiment of the invention, the yarn retainer element disposed in advance of the yarn guide plate in the yarn traveling direction is positioned such that, when the yarn guide plate pivots rearwardly into its initial position, the yarn then guided in the yarn placement slit is pushed out of the slit and is guided on the yarn retainer element to slide downwardly into the area of the changing device of the spooling station.

In a further embodiment of the invention, an injector device is disposed in the outlet area of the supply tube, which can be charged with compressed air in a defined manner via a controllable electromagnetic directional control valve. The disposition of the injection nozzle in the outlet area of the supplementary yarn conveying device assures a trouble-free yarn conveyance, since in such a device the yarn is advantageously subjected to a pulling component.

In a further embodiment of the invention, the supply tube has an outlet area which is bifurcated to terminate in two line sections spaced from each other, whereby the outlets of the two tubes can be alternatingly connected to an suction source via a specially designed slidable yarn cutting device. In this case, the yarn cutting device has a cutting and closure slider which can be actuated by means of a thrust piston gear and which has a forward cutting edge as well as a perforated screen at a rearward spacing behind the cutting edge.

Further features of the invention are explained in detail below by means of an exemplary embodiment represented in the drawings.

DETAILED DESCRIPTION OF THE PREFERRED EMBODIMENT

Figure 1:
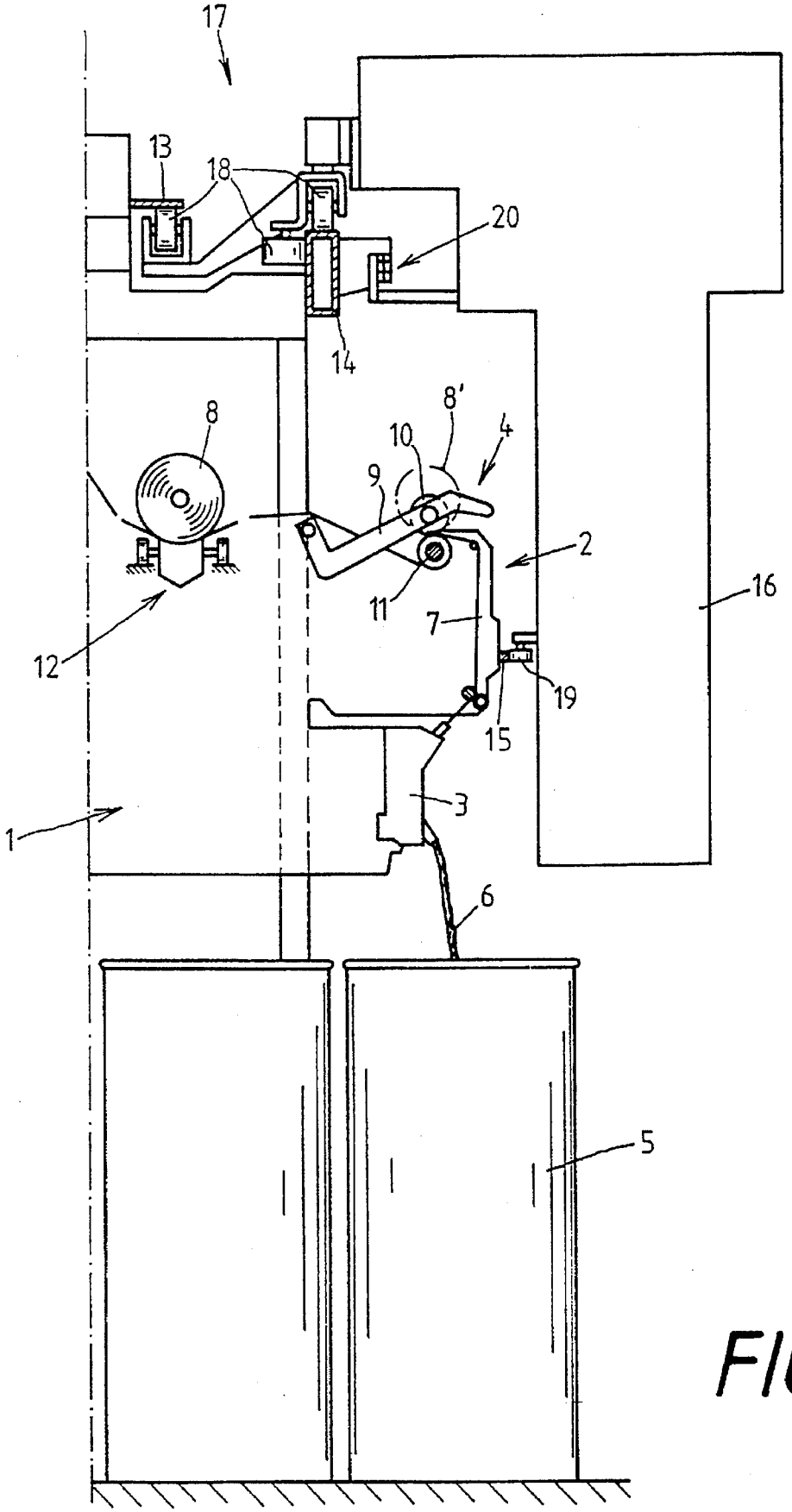
FIG. 1 is a schematic end elevational view of one side of an open end spinning machine equipped with a traveling service device having a supplementary yarn conveying device in accordance with a preferred embodiment of the present invention.

One longitudinal side or half of an open end spinning machine of a generally known type is indicated and identified by 1 in FIG. 1. Spinning machines of this type have a plurality of aligned work stations 2 extended side-by-side along each side of the machine, with each of the work stations being equipped with a spinning box 3 and a yarn winding or spooling device 4. At each work station, a silver 6, supplied from a silver can 5, is spun into a yarn 7 in the respective spinning box 3 and is wound into the form of a cheese-type package, such as represented by yarn cheeses 8, 8', by the associated spooling device 4. As represented, each spooling device 4 is equipped with a creel 9 for rotatably supporting a yarn tube 10 for winding thereon of a cheese 8, and with a drive roller 11 for frictional surface driving of the cheese.

The open end spinning machine 1 in addition has a circulating tube and bobbin conveying device 12 for supplying the work stations of the spinning machine with empty tubes and for removing fully wound cheeses therefrom.

A service device, for example a yarn joining unit 16, is disposed at or on the spinning machine 1 for traveling movement lengthwise along the work stations on guide rails 13, 14 as well as on a support rail 15. The running gear 17 of the yarn joining unit 16 has rollers 18 and a support wheel 19. The supply of electrical energy to the yarn joining unit 16 is preferably provided via a wiper contact device such as indicated schematically at 20. A yarn joining unit 16 of this type continuously patrols along the open end spinning machine 1 and operates independently if a need for action occurs at one of the work stations 2, for example, if a yarn breakage has occurred at a work station 2 or when a cheese in one of the work stations has attained its prescribed full diameter and must be replaced by an empty tube.

In such a case the yarn joining unit 16 travels to and is positioned at the respective work station. In case of a "normal" yarn break, the joining unit 16 utilizes a yarn locating nozzle 21 to search for the broken yarn end located on the surface of the cheese 8. After the spinning box has been cleared, the yarn end is reinserted into the rotor within the spinning box to be joined to the fiber ring rotating in the spinning rotor.

The service operation is more difficult if a full cheese must first be replaced by an empty tube and the new yarn joining process must be performed thereafter.

Figure 2:
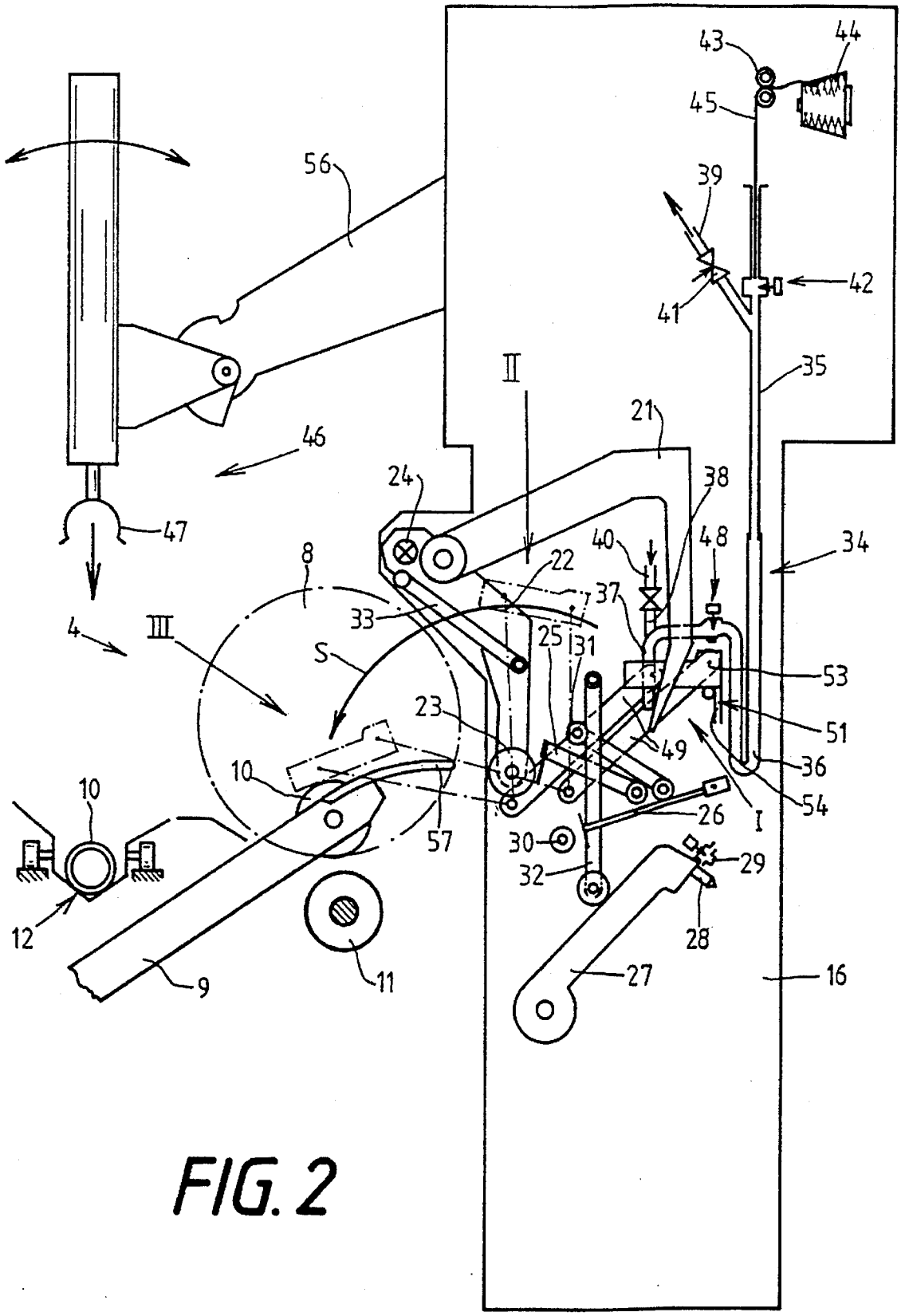
FIG. 2 is an enlarged end elevational view of the service device of FIG. 1, showing schematically its essential operating elements.

FIG. 2 schematically shows a yarn joining unit 16 with all of its essential operating elements required for performing the above mentioned operations. The yarn joining unit 16 has a tube gripper device 46 disposed on a console arm 56 above the running gear 17 and provided with gripper elements 47 matched to the exterior diameter of the empty tubes 10, which are conveyed alongside the area of the work stations 2 by means of the bobbin and tube conveying device 12. The yarn joining unit 16 furthermore has a pivotable yarn locating nozzle 21 having an aspirating slit which can be placed against the exterior circumference of the cheese 8 to pick up by aspiration torn-off yarn ends. Furthermore, an ejection and drive arm 22 with a drive roller 23 disposed at its end is also provided. The drive roller 23 is actuated by a drive motor (not shown) and can be disconnected from its drive motor via an electric clutch. An angle of rotation transmitter 24 is disposed on the drive arm 22 to permit the relative rotational position of the drive arm to be detected.

As is known, the yarn joining unit 16 is furthermore equipped with a yarn catch plate 25, a yarn insertion device 26, a yarn feeding device 27 with a feeding clamp 28, a yarn separating device 29 and a controllable yarn draw-off device which consists of a draw-off roller 30 as well as a pressure roller 31 which can be pivoted away.

A frame opener 32, a pressure lever 33 and a supplementary yarn conveying device 34 are installed in the yarn joining unit 16 as further operating elements. The supplementary yarn conveying device 34 essentially consists of a tube system 35, which is connected via a flexible connecting element 36, for example a hose, with a supply tube 37, which can be manipulated into various working positions. In this case, the supply tube 37 is fastened on a supply tube holder 53 which can be displaced by means of parallelogram links 49 in an arcuate path S. The supplementary yarn 45 is drawn off a supply bobbin 44 by a yarn delivery unit 43 and is fed into the tube system 35. The tube system 35 has a suction air connector 39 in a yarn inlet area, which can be selectively switched open and closed by means of a valve 41 in a defined manner. Furthermore, a yarn separating device 42 is provided in the tube system 35.

The yarn outlet or delivery end area of the supplementary yarn conveying device 34, i.e., the area in which the supply tube holder 53 is disposed, is shown in greater detail in FIGS. 3 to 6.

The supply tube holder 53 is preferably embodied as a bent plate element having angled seating projections 58, 59 and 60, 61, and seating shoulders 62, 63. The supply tube holder 53 is connected with the parallelogram links 49 via the seating shoulders 62, 63 and can be positioned in various work positions I, II and III along the arcuate path S represented in FIG. 2. The seating projection 59 is disposed at the front or forward facing side of the tube holder 53, as viewed in the yarn traveling direction, and also has a horizontal leg 59' on which a yarn retainer element 66 is fastened.

A yarn guide plate 54 of the yarn placement device 51 is rotatably seated between the seating projections 58, 59 on a pivot shaft 50. The yarn guide plate 54 is maintained in the initial position represented in FIG. 4 by means of a spring-loaded biasing device 52 and can be pivoted in the direction FR via a pneumatic thrust piston 55. The yarn guide plate 54 has a stop 67 for limiting the pivot path, which rests against the creel 9 in the outwardly pivoted state. A force limiting element 69, preferably in the form of a helical spring, is inserted between the piston rod of the pneumatic cylinder 55 and a stiffening plate 68 on the yarn guide plate 54. A yarn guide projection 80, whose contour conforms to the empty tube 10, is also fastened on the yarn guide plate 54.

Figure 3:
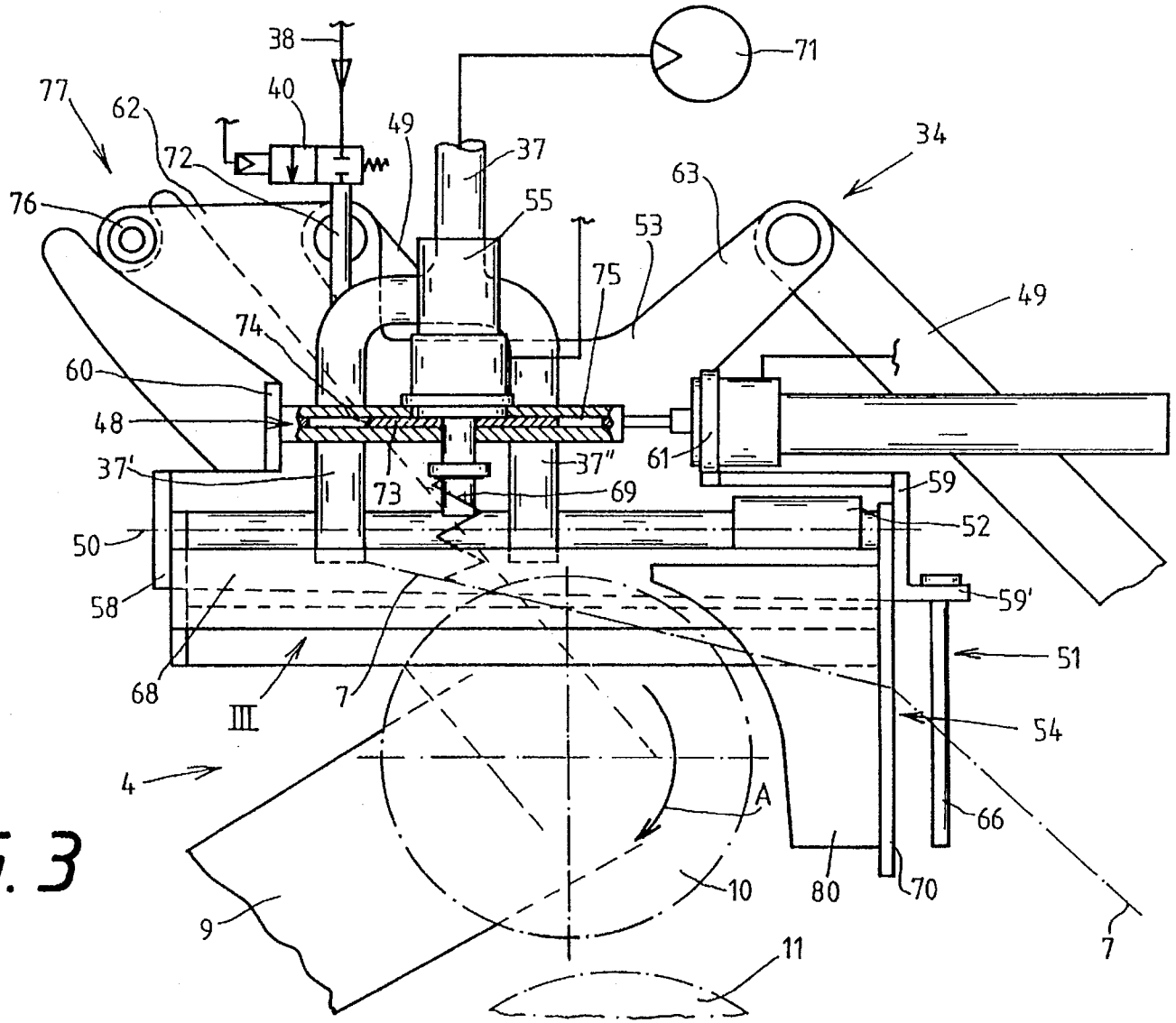
FIG. 3 is a lateral side elevational view of the end area of the supplementary yarn conveying device with the yarn placement arrangement in accordance with the present invention.

As can be further seen in FIG. 3, the yarn delivery tube 37 is divided into two tube sections 37', 37" in its end area, which are connected through the main portion of the tube 37 to a common suction air source 71. An injector device 72 is disposed in the area of the supply tube section 37' and is connected via a valve 40 to a compressed air line 38. The passages of the supply tube sections 37' and 37" can be specifically closed off by a cutting and closure slider 73 of a yarn cutting device 48. In particular, the cutting and closure slider 73 has a front cutting edge 74 for cutting a yarn 7 entering into the supply tube section 37 when the slider 73 is moved forwardly and has a perforated screen 75 spaced rearwardly from the cutting edge 74 at the same distance as the spacing between the outlet sections 37', 37" thereby to automatically connect the supply tube section 37" to the suction air source 71 upon forward cutting movement of the slider 73. In this manner, the supply tube section 37" is open during the cutting operation of the yarn cutting device 48, and during the remaining time of the yarn connecting cycle it is closed.

The detailed operation of the servicing device in accordance with the present invention may thus be understood. As soon as the yarn joining unit 16 has noted or has been advised via the data transmission system of the open end spinning machine 1 that servicing is required at a work station 2, the yarn joining unit 16 moves to this work station and is positioned thereat. Subsequently, the yarn joining unit 16 determines or is advised via the data transmission system of the open end spinning machine of the type of error which has occurred or the type of servicing action which is required at this work station, for example a "normal" yarn break or a cheese needing to be exchanged, etc. Depending on the type of occurrence or servicing to be carried out, the control unit of the yarn joining unit 16 initiates the appropriate programs of the different operations which are required.

If, for example, a cheese 8 has reached its maximum diameter and must be replaced by an empty tube 10, the following program steps take place. First, the tube gripping device 46, for example embodied as a telescopic gripper, is pivoted into the position shown in FIG. 2 and moves its gripper element 47 at the end of the device 46 outwardly in the direction of the tube and bobbin conveying device 12. The gripper element 47 is pushed over the empty tube 10 in the tube and bobbin conveying element 12 and is subsequently lifted up when the tube gripping device 46 is retracted into an upper position. After this the frame opener 32 acts on a guide shoulder 57 disposed on the arm of the creel 9 to push the arm of the creel 9 outwardly so that the cheese 8 is released and can be transferred into the tube and bobbin conveying device 12 by forward pivoting of the ejection and drive arm 22 of the yarn joining unit 16. During this operation the drive roller 23 disposed at the end of the drive arm 22 is disengaged from its drive in order to prevent damage to the cheese surface.

The frame opener 32 and a pressure lever 33 resting on the guide shoulder 57 pivot the creel 9 into an empty tube transfer position located at a predefined distance above the drive roller 11. While the creel 9 is in this predefined position, the gripper element 47 transfers the empty tube to the creel 9. The correct transfer of the empty bobbin 10 is monitored in the process by the angle of rotation transmitter 24 disposed on the drive arm 22, which detects a missing or incorrectly installed empty tube 10 as an error if the detected angular position of the drive arm 22 deviates from a reference value.

The yarn joining cycle is started simultaneously with the above described tube exchange operation. First, a supplementary yarn 45 is drawn off the supply bobbin 44 by the yarn delivery device 43 and conveyed through the supplementary yarn conveying device 34 to the outlet of the delivery tube 37. In this case, the supplementary yarn 45 is conveyed within the tube system 35 of the supplementary yarn conveying device 34 pneumatically, for example by means of the injector device 72 disposed in the area of the compressed air connector 38.

At this time, the delivery tube 37 is in its rear working position I, in which the outlet opening of the delivery tube 37 is in the immediate vicinity of the suction slit of the yarn locating nozzle 21 of the yarn joining unit 16. The yarn locating nozzle 21 is in a parked position, in which it does not interfere with the other operating elements disposed in the yarn joining unit. Thus, the end of the supplementary yarn 45 conveyed by means of the supplementary yarn conveying device 34 exits from the outlet of the delivery tube 37 and immediately is aspirated into the yarn locating nozzle 21. Subsequently, the delivery tube 37 pivots into a second working position II, not shown for reasons of better clarity.

In this second working position the outlet of the delivery tube 37 is approximately at the uppermost position of the pivot path S of the delivery tube 37. During the pivoting process, the supplementary yarn conveying device 34 delivers a length of the supplementary yarn 45 which is just sufficient to extend between the outlet of the delivery tube 37 and the yarn locating nozzle 21.

The supplementary yarn 45 extending between the outlet of the delivery tube 37 and the yarn locating nozzle 21 is then used by the yarn joining members of the yarn joining unit 16 for joining the yarn. Specifically, while the end of the supplemental yarn 45 continues to be held by aspiration within the nozzle 21, the trailing extent of the supplementary yarn 45 between the nozzle 21 and the delivery tube 37 is first engaged by the yarn catch plate 25 into a position to be transferred by the yarn insertion device 26 to the yarn feeder 27 wherein the yarn 45 is grasped in the feeding clamp 28 of the yarn feeder 27. Subsequently, the supplementary yarn 45 is cut by means of the yarn separating device 29 on the yarn feeder 27 and the cut off end is aspirated into and through the yarn locating nozzle 21 for disposal. The supplementary yarn conveying device is then switched to suction air and the length of the supplementary yarn 45 trailing from the clamped yarn end held by the yarn feeder 27 and extending inside the tube system 35 is cut by the yarn separating device 42, creating another end to the supplemental yarn 45 opposite the end held by the yarn feeder 27. The end of the supplementary yarn grasped in the feeding clamp 28 of the yarn feeder 27 is prepared in the customary manner, and the feeder 27 is pivoted forwardly to transfer the prepared yarn end into the spinning box 3 wherein the yarn end is placed against the circumferential ring of fibers formed centrifugally in the spinning rotor in known manner to join therewith for resumption of conventional open-end spinning.

The supplemental yarn end thusly joined to the fibers being formed into new yarn within the rotor is drawn off, together with the supplementary yarn 45, via the yarn draw-off device 30,31 and aspirated into the delivery tube 37.

Figure 4:
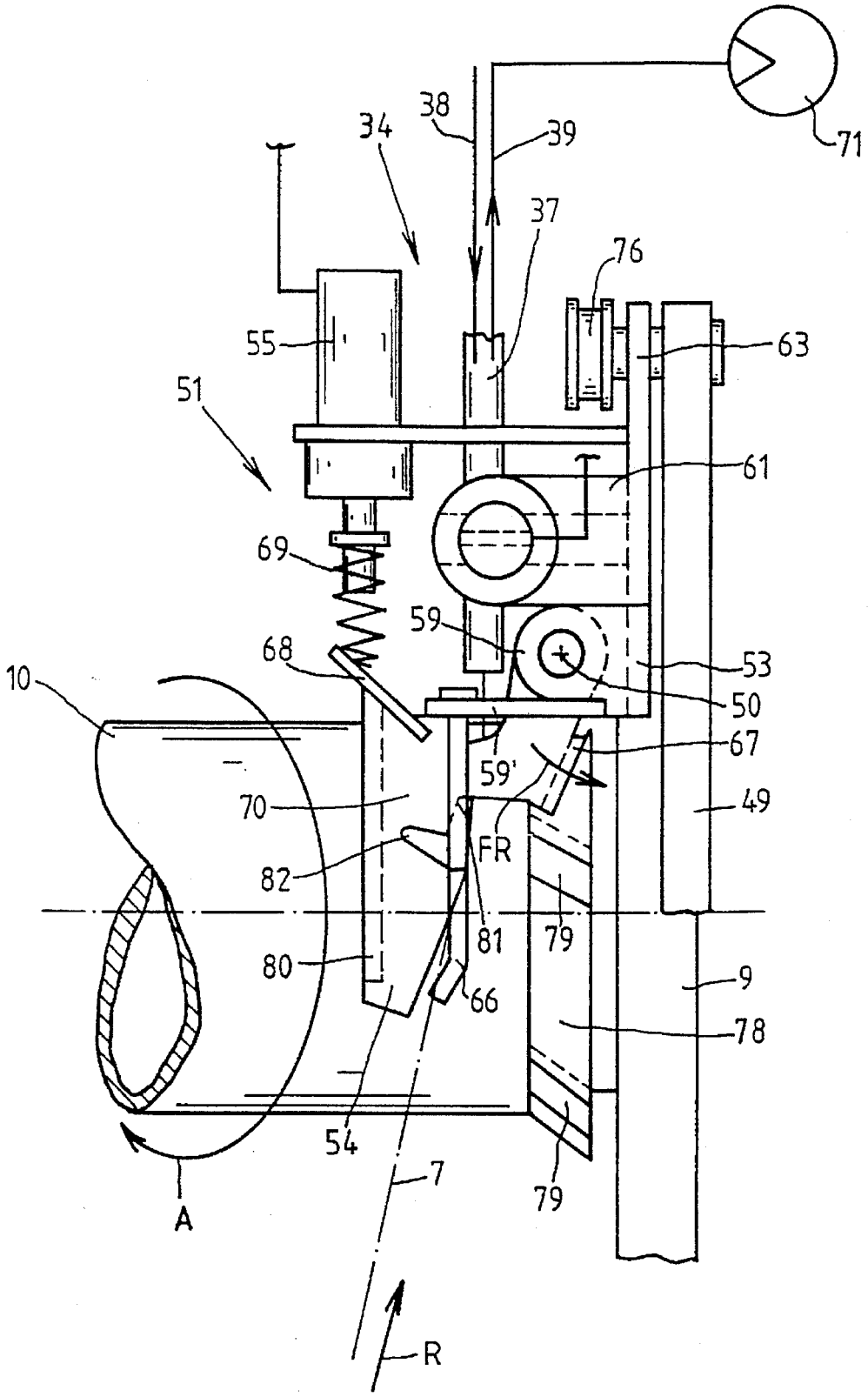
FIG. 4 is a front elevational view of the yarn placement arrangement of FIG. 3.
Figure 5:
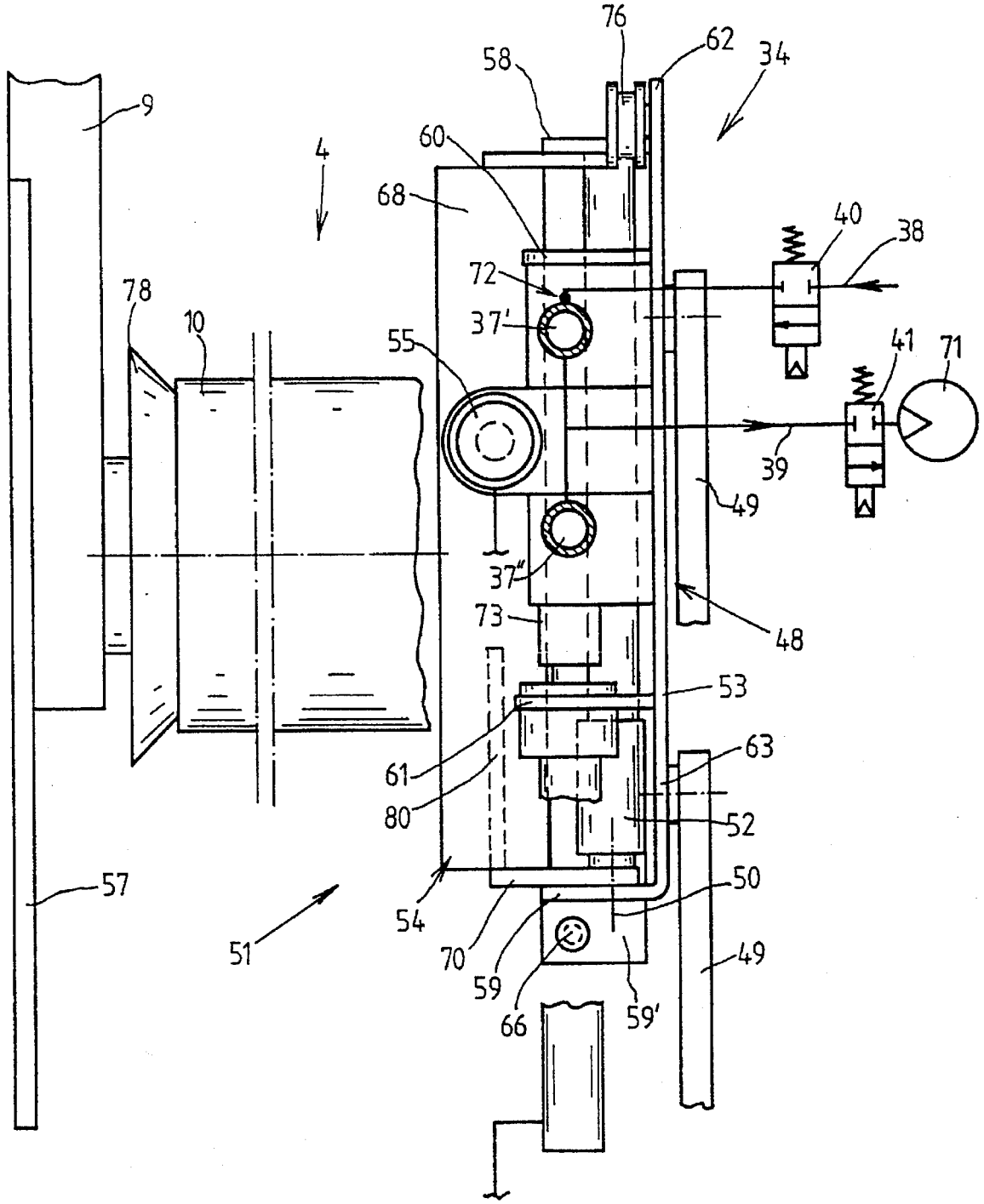
FIG. 5 is a top plan view, partially in section, of the placement arrangement of FIG. 3.
Figure 6:
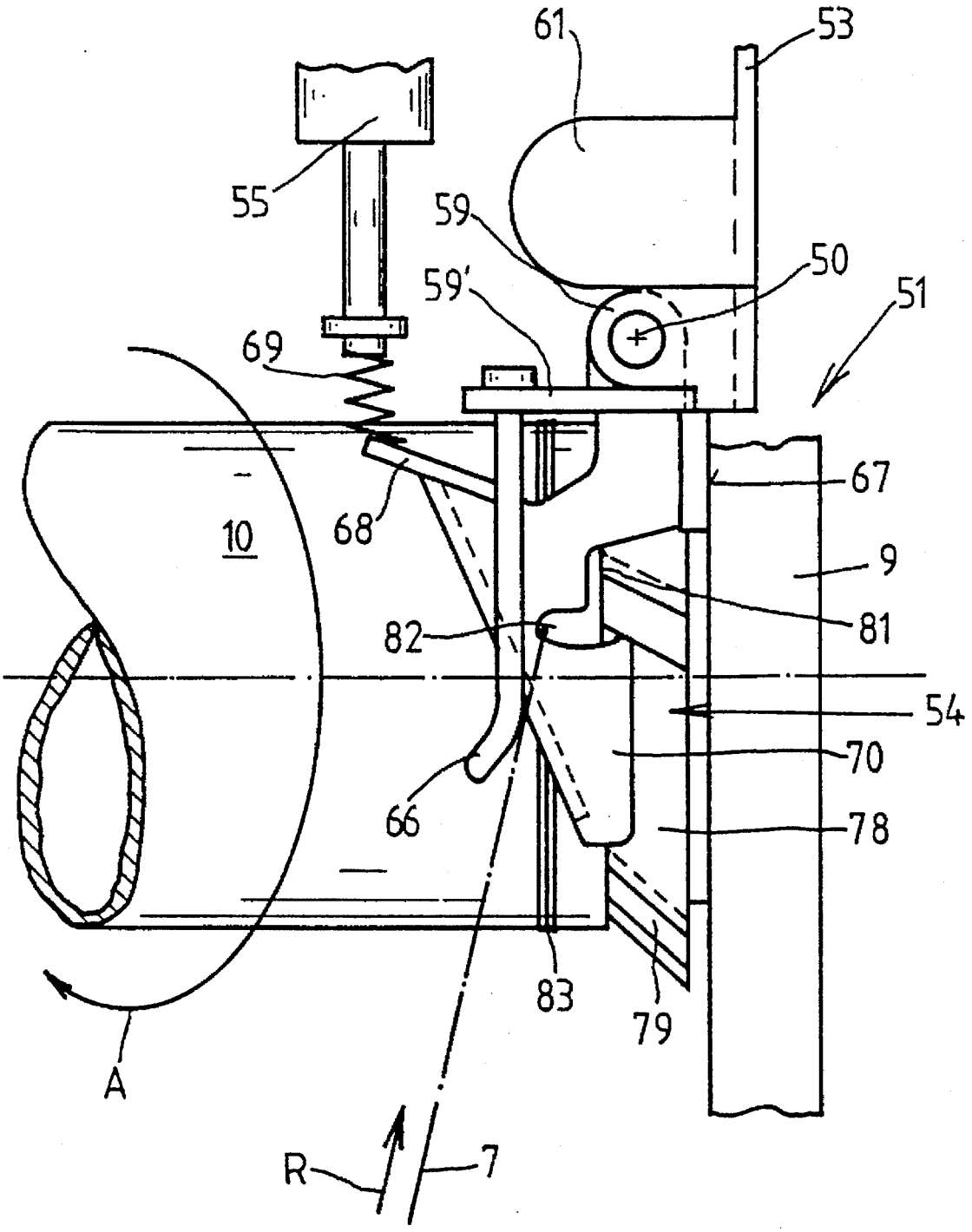
FIG. 6 is another front elevation of the yarn placement arrangement of FIG. 4, with the yarn guide plate pivoted outwardly.

As indicated in FIGS. 3 and 4, the delivery tube 37, which has been pivoted into the work position III (see also FIG. 2), subsequently places the newly formed yarn 7 drawn from the rotor against the empty tube 10. The empty tube 10 is maintained between tube supporting disks 78 of the creel 9, which as aforementioned is still located at this time in a spaced-apart position above the rotating drive roller 11. The empty tube is acted upon by the drive roller 23 of the drive arm 22 which thereby rotates the tube 10 and the supporting disks 78 in the direction A.

One of the rotating tube disks 78 has a yarn catch device 79 which consists, for example, of transport grooves undercut in a dovetail-shaped manner in the area of the disk edge. The yarn placement device 51 disposed on the delivery tube holder 53 then guides the yarn entering the opening of the delivery tube 37 over the tube disk 78 such that it can be grasped in the rotating transport grooves 79 disposed on the tube disk.

For this purpose, the yarn placement device 51 includes the aforementioned yarn guide plate 54 which has a yarn guide contour 70 to permit the defined guidance of the yarn 7 and is inwardly pivotable by actuation of the pneumatic drive 55. In particular, as can be seen from FIGS. 4 and 6, the yarn guide plate 54 is seated, partially rotatable, on the pivot shaft 50 and its yarn guide contour 70 is embodied in an approximate L-shape, including a yarn guide notch 81 and a yarn placement slit 82.

As already briefly mentioned above, at the start of the yarn joining process, the yarn 7 enters the tube section 37' of the delivery tube 37 which is positioned at that time in the working position III (FIG. 3; see also FIG. 2). As indicated in FIG. 4, in this case, the yarn 7 lies in the yarn guide notch 81 of the yarn guide contour 70. The guide plate 54, and therefore its yarn guide contour 70, is pivoted in the direction FR by appropriate control of the pneumatic cylinder 55, until the pivot path is obstructed by the stop 67 resting on the creel 9. In the process, the yarn guided in the yarn guide notch 81 is drawn over the tube supporting disk 78 such that it is grasped by the yarn catch device 79 disposed in the tube disk 78. The empty tube 10 which is surface driven by the drive roller 23 on the work arm 22 to rotate in the direction A correspondingly rotates the tube disk 78, so that the grasped yarn is displaced downwardly in the direction A. In the course of this movement, the yarn 7 slides out of the yarn guide notch 81 and moves into the yarn placement slit 82. At the same time, the yarn 7 entering the tube section 37' is cut by means of the yarn separating device 48. The yarn guided in the yarn placement slit 82 is then wound on the empty tube 10 into a reserve winding 83 (see FIG. 6) and is subsequently lowered together with the empty tube onto the drive roller 11 to resume normal ongoing winding of yarn from the rotor onto the new tube.

To prevent the cut-off yarn end from flapping around uncontrolled, the outlet area of the delivery tube 37 is provided with the aforementioned second tube section 37". When the yarn 7 extending into the tube section 37' is cut, an automatic switching is performed by the slider 73 of the yarn separating device 48 as above-described to connect the tube section 37" to the suction source 71. Specifically, the arrangement of the cutting and closure slider 73 with the front cutting edge 74 as well as the rearwardly spaced perforated screen 75 insures that simultaneously with the cutting of the yarn 7 entering the tube section 37' the tube section 37", which normally is closed, is connected to the suction air source 71 so that the yarn end which was cut in the tube section 37' is immediately aspirated into the tube section 37" and thereby fixed in place. In addition, a yarn guide shoulder 80, whose guide edge is matched to the shape of the empty tube 10, is provided rearwardly of the yarn guide contour 70 for guiding the cut yarn end.

In order to assure at all times a reproducible position of the delivery tube 37 in respect to the empty tube held in the creel 9, a fork-shaped stop 77 is provided on the creel 9, which is engaged by a positioning aid 76 disposed on the delivery tube holder 53 during the pivoting of the delivery tube 37 into the work position III.

Following the application of the reserve winding 83, the yarn guide plate 54 is pivoted back into its initial position. In the process, the yarn 7, while supported on the yarn retainer element 66 disposed ahead of the yarn guide plate 54 in the yarn traveling direction R, slides out of the yarn placement slit 82. The empty tube 10, rotating in the direction A, pulls the yarn downward at the yarn retainer element 66, so that it comes free of the yarn placement device 51 and can be transferred to the changing device (not shown) of the spooling station. The operating cycle of the service device for the exchange of the full cheese for the empty tube and placement of the yarn onto the new tube is thereby ended and terminated. The supplementary yarn conveying device 34 is pivoted back into its initial position and the yarn joining unit 16 is ready for another operation.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In combination, a textile machine having a plurality of work stations each operable for winding a yarn onto a winding tube to form a cheese-type yarn package, each said work station having means for driving the respective winding tube in a rotational direction, the tube driving means including a yarn catching means engageable with one end of the winding tube, and a service device for the textile machine, the service device comprising:

(a) a frame;

(b) means for transporting the frame along the textile machine for positioning at a selected work station;

(c) a supplementary yarn conveying device mounted on the frame for providing a length of a supplementary yarn, the supplementary yarn conveying device including a delivery tube for supplying the supplementary yarn therein;

(d) means for joining the supplementary yarn to the yarn at the selected work station;

(e) a yarn placement device for manipulating the supplementary yarn onto the winding tube at the selected work. station; and (f) a device for holding the delivery tube and the yarn placement device for selective unitary movement thereof to and from a position adjacent the yarn winding tube at the selected work station, the yarn placement device including a yarn guide plate having a contoured yarn guide surface defining spaced first and second yarn engagement recesses, the yarn guide plate being pivotally movable between a first position for engaging the supplementary yarn in the first yarn engagement recess at a spacing from said one end of the winding tube and a second position adjacent said one end of the winding tube for placing the supplementary yarn into the yarn catching means at said one end of the winding tube and transferring the supplementary yarn into engagement in the second yarn engagement recess during winding rotation by said driving means to form a reserve winding of the supplementary yarn on the winding tube.

2. The combination of claim 1, wherein the service device further comprises means for axially aligning the guide plate with respect to the yarn winding tube.

3. The combination of claim 2, wherein said means for axially aligning comprises a positioning surface disposed on the textile machine and a stop disposed on the yarn guide plate for contacting the positioning surface during the pivotal movement of the yarn guide plate from the first position so as to locate the yarn guide plate at the second position.

4. The combination of claim 1, wherein said second yarn engagement recess is a yarn placement slit.

5. The combination of claim 4, wherein the holding device comprises means for causing the supplementary yarn to travel in a longitudinal path to said winding tube and said yarn placement device further comprises a yarn retainer element, the yarn retainer element and the yarn guide plate being located adjacent the longitudinal path of the supplementary yarn with the yarn retainer element upstream of and laterally offset from the yarn guide plate in its first position with respect to the longitudinal path, the yarn guide plate in its first position being disposed with the yarn placement slit out of contact with the supplementary yarn.

6. The combination of claim 1, wherein the yarn guide plate is seated rotatably on a horizontal pivot shaft and is biased by a spring-located biasing device disposed in the area of the pivot shaft, and a pneumatic thrust cylinder is provided for actuating the pivotal movement of the yarn guide plate.

7. The combination of claim 6, wherein a force-limiting element is disposed between the thrust cylinder and the yarn guide plate.

8. A service device for a cheese-producing textile machine in accordance with claim 7, wherein the force-limiting element comprises a helical spring.

9. The combination of claim 1, wherein the delivery tube of the supplementary yarn conveying device has a compressed air connector with an injector device in a yarn cutting device in the area of the holding device.

10. The combination of claim 1, wherein the delivery tube has a bifurcated outlet defining spaced-apart outlet sections and a yarn cutting device having a cutting and closure slider displaceable across the outlet sections.

11. The combination of claim 10, wherein the cutting and closure slider has a forward-facing cutting edge and a rearward perforated screen spaced from the cutting edge.

12. The combination of claim 1, wherein the service device further comprises means for aligning the delivery tube with the winding tube.

13. The combination of claim 12, wherein the means for aligning the delivery tube comprises a stop on the work station and a positioning element disposed on the holding device for contacting the stop on the work station during movement of the holding device to its position adjacent the yarn winding tube, so as to align the delivery tube with the yarn winding tube.

14. A yarn placement device for guiding a yarn onto a winding tube on a textile machine, the textile machine having means for driving the winding tube in a rotational direction, the tube driving means including a yarn catching means engageable with one end of the winding tube, the yarn placement device comprising:

a yarn guide plate having a contoured yarn guide surface defining spaced first and second yarn engagement recesses; and the yarn guide plate being pivotally movable between a first position for engaging the yarn in the first yarn engagement recess at a spacing from said one end of the winding tube and a second position adjacent said one end of the winding tube for placing the yarn into the yarn catching means at said one end of the winding tube and transferring the yarn into engagement in the second yarn engagement recess during winding rotation by said driving means to form a reserve winding of the yarn on the winding tube.

* * * * *